United States Patent [19]

Shimada et al.

[11] Patent Number: 4,836,981

[45] Date of Patent: Jun. 6, 1989

[54] CONCRETE REINFORCING STEEL BAR OR WIRE

[75] Inventors: Haruo Shimada; Yoshiaki Sakakibara, both of Kawasaki, Japan

[73] Assignee: Nippon Steel Corporation, Tokyo, Japan

[21] Appl. No.: 148,138

[22] Filed: Jan. 25, 1988

Related U.S. Application Data

[63] Continuation-in-part of Ser. No. 16,105, Feb. 18, 1987, abandoned.

[30] Foreign Application Priority Data

Feb. 25, 1986 [JP] Japan ..... 61-38406
May 23, 1986 [JP] Japan ..... 61-117540

[51] Int. Cl.[4] ..... C22C 38/06

[52] U.S. Cl. ..... 420/79; 420/80; 420/81

[58] Field of Search ..... 420/77, 79, 80, 81; 428/586; 148/333, 334, 335, 12 B

[56] References Cited

U.S. PATENT DOCUMENTS 2,499,862 3/1950 Hansen ..... 420/80

FOREIGN PATENT DOCUMENTS 56-9356 1/1981 Japan ..... 420/121
387971 2/1933 United Kingdom ..... 420/79
1002057 8/1964 United Kingdom ..... 420/79

*Primary Examiner*—Deborah Yee
*Attorney, Agent, or Firm*—Wenderoth, Lind & Ponack

[57] ABSTRACT

Concrete reinforcing steel bars or wires useful for reinforcing concrete structures, such as concrete structures built on seashores and marine concrete structures, and concrete bridges, which are exposed to sea salt particles and sea-water splashes, and very excellent in preventing deteriorations or decays of these concrete structures. The steel bars or wires have the following composition, C: not more than 1.0%
Si: not more than 0.25%
Mn: not more than 2.0%
Al: 10.0 to 20.0%
CR: 0.5 to 5.5%
P: not more than 0.015%
S: not more than 0.005%
Balance: iron and unavoidable impurities.

The steel bars or wires may further contain at least one element selected from Ti, V, Nb, W, Mo or B in such amounts that the total weight range for elements other than B is 0.01 to 0.5% and in amounts ranging from 0.0001 to 0.0005% for B. The bar or wire also may optionally contain Cu and/or Ni in total amounts ranging from 0.1 to 5.5%.

4 Claims, No Drawings

CONCRETE REINFORCING STEEL BAR OR WIRE

This application is a continuation-in-part of now abandoned application Ser. No. 016,105, filed Feb. 18, 1987, now abandoned.

BACKGROUND OF THE INVENTION

1. Field of the Invention:

The present invention relates to concrete reinforcing steel bars or wires useful for reinforcing concrete structures, such as concrete structures built on seashores and marine concrete structures, and concrete bridges, which are exposed to sea salt particles and sea-water splashes, and very excellent in preventing deteriorations or decays of these concrete structures.

2. Description of the Related Art:

In recent years, keen attentions have been paid in various fields of industries to the problem of concrete decays due to cracks in reinforced concrete structures built with use of sea sand or built on seashores, and various preventive methods have been proposed and indeed some of them have already been put into practice.

The principal cause for the concrete decays or deteriorations has been found to be attributable to the fact that steel bars or wires embedded in the concrete structure are corroded by salts contained in the sea sand mixed in the concrete or by the sea salt particles permeating into the concrete structures built on the seashores or in oceans and increase in their volume by about 2.2 times due to the corrosion, and the concrete fails to stand against the expansion force of the corroding steel bars or wires and cracks along the embedded reinforcing bars or wires, and that when the cracks grow about 0.2 mm or larger, exterior corrosive media, such as oxygen, salts, and carbon dioxide in the air penetrate through these cracks into the interiors of the concrete structure where the reinforcing bars or wires are embedded to promote the corrosion of the bars or wires, or to accelerate neutralization of the concrete, causing premature decay of the concrete structures.

For the purpose of preventing such decays of concrete structures, the present inventors have conducted extensive studies and experiments to improve the salt resistance of the reinforcing steel bars or wires by controlling their chemical composition and developed concrete reinforcing steel bars or wires having remarkably improved salt resistance, as disclosed in Japanese Laid-Open Patent Applications Nos. Sho 57–48054 and Sho 59–44457 and widely published in "OFFSHORE GOTEBORG '81", Paper No. 42, Goteborg Sweden, 1981; "CEMENT CONCRETE" No. 434 (1983), Pages 23 to 31; "CORROSION OF REINFORCEMENT IN CONCRETE CONSTRUCTION" Page 419, 1983; and "KENCHIKU NO GIJUTSU SEKŌ" (Practice for Building Construction) No. 229, 1985, Jan. Pages 155 to 164 published by Shokokusha, Japan.

Also details of the salt resistance mechanism at initial stages of steel compositions of the reinforcing bars or wires which contribute for improving the salt resistance of reinforcing bars or wires per se are reported in these technical papers.

SUMMARY OF THE INVENTION

Therefore, one of the objects of the present invention is to prevent the corrosion of concrete renforcing steel bars or wires by salts in the form of free Cl ions contained in the sea salt particles or sea-water splashes permeating through the concrete walls, and thereby prevent the cracking and decaying of the concrete induced by the corrosion of the bars or wires. The corrosion of the reinforcing steel bars or wires and the cracking and decaying of the concrete structures have been given special caution along with developments of salt resistant reinforcing steel bars or wires.

More imminent problems to be solved are now turning out in connection with concrete structures of more than ten years old in many fields that the free salt content around the reinforcing bars or wires embedded in the concrete structures reaches as high as 1.0% in the term of NaCl in severe marine environments, which causes serious corrosion of the reinforcing bars or wires, which in turn causes and promotes cracking of the concrete structures.

Therefore, it is another object of the present invention to provide concrete reinforcing steel bars or wires which can well resist against the attack by the high concentration of free salt, thus eliminating the possible cracking of the concrete structures.

The above objects are achieved by the following concrete reinforcing steel bars or wires having a basic steel composition consisting essentially of:

C: not more than 1.0%
Si: not more than 0.25%
Mn: not more than 2.0%
Al: 10.0% to 20.0%
CR: 0.5 to 5.5%
P: not more than 0.015%
S: not more than 0.005%
Balance: iron and unavoidable impurities.

The above basic steel composition may be modified by addition of at least one of Ti, V, Nb, W, Mo, and B in an amount ranging from 0.01 to 0.5% for the elements other than B, and in an amount ranging from 0.0001 to 0.005% for B, and/or addition of at least one of Cu and Ni in an amount ranging from 0.1 to 5.5%.

DETAILED DESCRIPTION OF THE INVENTION

The most important feature of the present invention resides in that a large amount of Al, as large as 10.0 to 20.0%, is contained so as to produce a strong passivated film on the surface of the reinforcing steel bars or wires embedded in the concrete structures which are exposed to a high concentration of salt, thereby almost completely preventing rust formation on the surface of the embedded bars or wires, hence completely preventing decay of the concrete in which the bars or wires are embedded.

Thus the present invention is based on the technical notion to completely eliminate or suppress the rust formation on the reinforcing steel bars or wires, despite the high concentration of salt as mentioned above, and is not based on the conventional technical notion to restrict the growth of rust. Although theoretical clarification for the mechanism of preventing or suppressing the rust formation is still to be made, it is assumed that $Al^{3+}$ dissolved out from the alloy steel reacts with $Cl^-$ to produce $AlCl_3$ which reacts with $OH^-$ in the water and is instantaneously converted into a very stable $Al(OH)_3$ and this $Al(OH)_3$ grows to shield the corrosive factors. This assumption can be proved by the fact that the surface potential of the reinforcing steel bar immersed in an aqueous solution of $Ca(OH)_2$ containing 3.6% NaCl (pH 12) rapidly shifts toward the noble side along the lapse of time (days).

Explanation will be made on reasons for limiting the contents of the individual elements as defined above in the present invention.

Carbon is limited to an amount not more than 1.0% for the reason that more than 1.0% carbon will cause embrittlement of the steel. Similarly the Mn content is limited to an amount not more than 2.0% for the reason that Mn contents more than 2.0% will cause embrittlement of the steel. A preferable range of the Mn content is up to 0.8%. The reason for limiting the Si content to an amount not more than 0.25% is that Si contents more than 0.25% will remarkably promote graphitization of cementites in the steel to lower the workability of the steel. Generally, as the Si content is lowered, the tendency of rust formation can be lessened. Therefore, a lower Si content is more desirable and the most preferable range for the Si content is less than 0.05%.

Al is the most critical element for the present invention and is particularly important for it is effective to suppress the rust formation even under environments of very high salt concentrations. This suppressive effect cannot be expected with Al contents less than 10.0%, but on the other hand, when Al is present in amounts more than 20.0%, not only economical disadvantage comes out, but also intermetallic compounds are produced, which will embrittle the steel. The most preferable range for the Al content is from 10 to 15%.

The reason for limiting the P content to an amount not more than 0.015% is that P contents more than 0.015% will not be effective to suppress the rust formation under alkaline environments such as in concrete, but rather will tend to promote the rust formation.

The reason for limiting the S content to an amount not more than 0.005% is to reduce the amount of MnS which is a source of rust generation. Meanwhile Ca compounds and rare earth elements used as desulfurizer for lowering the S content convert MnS into (Mn, Ca)S etc. In this way, improvement of corrosion resistance of the steel can be expected. And it is a very common practice in the steel making to lower the sulfur content with use of the above desulfurizers, and it is unavoidable that a small amount of Ca, Ce etc. will come into the steel. These elements produce no adverse effect on the properties, corrosion resistance in particular, of the steel. Therefore these elements may be present in amounts so far as unavoidably coming into the steel due to their addition for the desulfurization of the steel.

As cases demand, Ti, V, Nb, W, Mo, B, etc. may be added, as conventionally practised, for the purpose of improving the strength and toughness of the steel required for the concrete reinforcing bar or wire. These elements may be added in single or in combination in an amount ranging from 0.01 to 0.5% for the elements other than B and in an amount ranging from 0.0001 to 0.005% for B as well known in the art for the above purposes.

Further, one or both of Cu and Ni are added in amounts ranging from 0.1 to 5.5% for the purpose of improving the weather resistance of the steel so as to protect the steel until it is embedded in the concrete.

Still further, when free machinability is required, for example when the reinforcing bars are screwed, 0.01 to 0.5% Pb is added.

In the Cr modified basic steel composition, the Cr content is limited to an amount ranging from 0.5 to 5.5% for the reason that chromium addition will improve the strength and toughness of the steel, and particularly when present in amounts from 0.5 to 5.5% will improve the hot workability of the steel when the Al content is 7.0% or more, but chromium contents more than 5.5% will tend to embrittle the steel. The most preferable Cr content is from 0.7 to 2.0%.

The steel having the chemical compositions mentioned hereinbefore may be prepared by melting in a converter or electric furnace, then the steel is subjected to ingot-making and braking down, or continuous casting, and then rolling and heat treatments such as patenting, if necessary, and finally drawing into bars or wires. The bars or wires thus obtained may be directly used as concrete reinforcing bars or wires or may be galvanized or applied with an organic coating.

Detailed Description of the Preferred Embodiments

EXAMPLE 1

Steels having the chemical compositions shown in the table were melted in a vacuum melting furnace, made into ingots, broken down, and then drawn into concrete reinforcing bars and thus obtained bars were subjected to corrosion tests in comparison with concrete reinforcing bars of conventional chemical compositions. The results are shown in the table.

The corrosion tests were conducted as below.

Test pieces of 25 mm wide 60 mm long and 2 mm thich were taken from the central portion of the bars and surface-ground by machining.

Meanwhile, an aqueous solution of $Ca(OH)_2+NaCl$ (pH 12) was prepared by dissolving CaO which is the main component of the cement in 3.6% NaCl aqueous solution.

Then the test pieces prepared above were covered with silicone resin on the side surfaces and the back surface, degreased, dried and immediately immersed in the $Ca(OH)_2+NaCl$ solution as prepared above, during the testing, the surface of the solution was sealed with flowing paraffin. The immersion test was continued for 20 days by replacing the solution every three days to obverse the rust formation. In the table, (A) represents the area of rust formation (%), and (B) represents the depth (mm) of the local corrosion.

EXAMPLE 2

Reinforcing bars as hot rolled (9 mm in diameter) having the chemical compositions shown in the table were embedded in the concrete mortar composed of sand containing 1.0% NaCl portland cement, water and aggregate and aged therein for 28 days at ordinary temperatures, and then exposed on the seashore for one year. The water-cement ratio was 0.60 and the embedding depth was 2 cm.

After the one year exposure, the concrete was broken to observe the rust formation on the embedded bars. The results are shown in Table 1–2, (C) to 4–2 (C).

From the results shown in Table 1–2 (A), (B), (C) to 4–2 (A), (B), (C), it is clearly shown that the concrete reinforcing steel bars according to the present invention are completely free from the rust formation despite the high concentration of NaCl in the concrete, as high as 1.0% in the term of NaCl content in the sand and 3.6% in the term of NaCl content in water, and that the rust formation and hence the decay of the concrete can be completely prevented. Therefor it can be reasonably presumed that the reinforcing wires according to the present invention can also completely suppress the decay of the concrete in the most severe marine environments.

Concludingly, the present invention provides concrete reinforcing bars or wires which are remarkably advantageous and effective to maintain the durability of concrete structures exposed to salt damages and seawater splashes which are considered to present increasing problems in the future. With the use of the reinforcing bars or wires according to the present invention, it is possible to elongate the service life of concrete structures and improve their stability in various fields of applications.

TABLE 1

| | | Steel Composition | | | | | | | | Corrosion after Immersion in an Aqueous Solution of $Ca(OH)_2$ + 3.6% NaCl (ph 12) | | Corrosion in High-Salt Containing Concrete |
|---|---|---|---|---|---|---|---|---|---|---|---|---|
| | No. | C | Si | Mn | P | S | Al | Cr | Others | Rust Formation Area (%) (A) | Depth of Local Corrosion (mm) (B) | Rust Formation Area (%) (C) |
| Conventional Steels | 1 | 0.128 | 0.080 | 0.55 | 0.023 | 0.0170 | 0.004 | | Cu 0.44, Ni 1.0 | 5.0 | 0.42 | 5.7 |
| | 2 | 0.209 | 0.235 | 0.37 | 0.019 | 0.0175 | 0.028 | | Cu 0.02 | 5.2 | 0.37 | 5.8 |
| | 3 | 0.250 | 0.220 | 0.65 | 0.022 | 0.0300 | 0.020 | | Cu 0.18 | 4.8 | 0.33 | 6.2 |
| | 4 | 0.050 | 0.050 | 0.03 | 0.008 | 0.002 | 3.0 | | | 5.1 | 0.28 | 7.9 |
| | 5 | 0.001 | 0.003 | 0.01 | 0.002 | 0.001 | 5.0 | | | 5.3 | 0.29 | 6.8 |

TABLE 2

| | | Steel Composition | | | | | | | | Corrosion after Immersion in an Aqueous Solution of $Ca(OH)_2$ + 3.6% NaCl (ph 12) | | Corrosion in High-Salt Containing Concrete |
|---|---|---|---|---|---|---|---|---|---|---|---|---|
| | No. | C | Si | Mn | P | S | Al | Cr | Others | Rust Formation Area (%) (A) | Depth of Local Corrosion (mm) (B) | Rust Formation Area (%) (C) |
| Present Invention Steels | 6 | 0.80 | 0.20 | 0.23 | 0.012 | 0.002 | 10.0 | 0.5 | Cu 0.5 | 0 | 0 | 0 |
| | 7 | 0.78 | 0.18 | 0.20 | 0.010 | 0.001 | 12.0 | 0.5 | Cu 0.5, W 0.2 | 0 | 0 | 0 |
| | 8 | 0.08 | 0.01 | 0.05 | 0.015 | 0.002 | 12.5 | 0.8 | | 0 | 0 | 0 |

TABLE 3

| | | Steel Composition | | | | | | | | Corrosion after Immersion in an Aqueous Solution of $Ca(OH)_2$ + 3.6% NaCl (ph 12) | | Corrosion in High-Salt Containing Concrete |
|---|---|---|---|---|---|---|---|---|---|---|---|---|
| | No. | C | Si | Mn | P | S | Al | Cr | Others | Rust Formation Area (%) (A) | Depth of Local Corrosion (mm) (B) | Rust Formation Area (%) (C) |
| Present Invention Steels | 9 | 0.30 | 0.01 | 0.05 | 0.015 | 0.001 | 12.7 | 1.0 | | 0 | 0 | 0 |
| | 10 | 0.85 | 0.01 | 0.30 | 0.015 | 0.001 | 12.8 | 1.2 | | 0 | 0 | 0 |
| | 11 | 0.83 | 0.01 | 0.05 | 0.015 | 0.001 | 7.8 | 0.7 | | 0 | 0 | 0 |
| | 12 | 0.84 | 0.01 | 0.05 | 0.015 | 0.001 | 12.3 | 2.0 | | 0 | 0 | 0 |
| | 13 | 0.85 | 0.01 | 0.05 | 0.015 | 0.001 | 12.6 | 1.0 | | 0 | 0 | 0 |
| | 14 | 0.01 | 0.004 | 0.005 | 0.002 | 0.0008 | 8.0 | 1.5 | | 0 | 0 | 0 |
| | 15 | 0.001 | 0.005 | 0.005 | 0.002 | 0.001 | 19.8 | 2.8 | | 0 | 0 | 0 |
| | 16 | 0.05 | 0.05 | 0.30 | 0.010 | 0.002 | 10.0 | 1.0 | | 0 | 0 | 0 |
| | 17 | 0.31 | 0.008 | 0.10 | 0.010 | 0.001 | 16.0 | 1.1 | | 0 | 0 | 0 |
| | 18 | 0.28 | 0.007 | 0.18 | 0.010 | 0.001 | 10.0 | 1.2 | B 0.0005 | 0 | 0 | 0 |
| | 19 | 0.87 | 0.01 | 0.10 | 0.010 | 0.002 | 15.0 | 2.3 | Cu 0.25 | 0 | 0 | 0 |
| | 20 | 0.85 | 0.01 | 0.08 | 0.010 | 0.001 | 12.0 | 3.1 | Ni 3.48 | 0 | 0 | 0 |
| | 21 | 0.01 | 0.01 | 0.10 | 0.015 | 0.001 | 10.0 | 1.8 | Ti 0.15 | 0 | 0 | 0 |
| | 22 | 0.07 | 0.01 | 0.25 | 0.011 | 0.002 | 11.0 | 1.5 | V 0.11 | 0 | 0 | 0 |
| | 23 | 0.15 | 0.05 | 0.31 | 0.010 | 0.001 | 18.0 | 1.0 | Nb 0.03 | 0 | 0 | 0 |
| | 24 | 0.17 | 0.04 | 0.29 | 0.010 | 0.001 | 12.3 | 1.0 | Mo 0.11 | 0 | 0 | 0 |
| | 25 | 0.03 | 0.03 | 0.51 | 0.015 | 0.001 | 11.8 | 0.8 | W 0.12 | 0 | 0 | 0 |
| | 26 | 0.85 | 0.01 | 0.10 | 0.010 | 0.001 | 10.0 | 1.9 | V 0.1, Nb 0.05 | 0 | 0 | 0 |
| | 27 | 0.85 | 0.01 | 0.10 | 0.012 | 0.001 | 10.9 | 1.8 | | 0 | 0 | 0 |
| | 28 | 0.85 | 0.01 | 0.15 | 0.011 | 0.001 | 12.1 | 0.8 | Nb 0.03, Cu 0.23 | 0 | 0 | 0 |
| | 29 | 0.05 | 0.01 | 0.80 | 0.012 | 0.002 | 15.0 | 0.7 | W 0.02, Ti 0.18 | 0 | 0 | 0 |
| | 30 | 0.01 | 0.15 | 1.20 | 0.010 | 0.003 | 20.0 | 2.5 | B 0.0001, Ti 0.10 | 0 | 0 | 0 |
| | 31 | 0.007 | 0.006 | 0.01 | 0.002 | 0.0008 | 20.0 | 1.2 | B 0.0002, Mo 0.1 | 0 | 0 | 0 |
| | 32 | 0.03 | 0.20 | 1.80 | 0.001 | 0.001 | 7.0 | 2.0 | W 0.12, V 0.1 | 0 | 0 | 0 |
| | 33 | 0.08 | 0.01 | 0.12 | 0.008 | 0.001 | 8.1 | 2.5 | Mo 0.15, Nb 0.03 | 0 | 0 | 0 |
| | 34 | 0.05 | 0.005 | 0.10 | 0.015 | 0.002 | 12.0 | 1.5 | B 0.001, Ni 3.5 | 0 | 0 | 0 |

TABLE 4

| | | Steel Composition | | | | | | | | Corrosion after Immersion in an Aqueous Solution of $Ca(OH)_2$ + 3.6% NaCl (ph 12) | | Corrosion in High-Salt Containing Concrete |
|---|---|---|---|---|---|---|---|---|---|---|---|---|
| | No. | C | Si | Mn | P | S | Al | Cr | Others | Rust Formation Area (%) (A) | Depth of Local Corrosion (mm) (B) | Rust Formation Area (%) (C) |
| Present | 35 | 0.80 | 0.020 | 0.005 | 0.010 | 0.001 | 10.0 | 1.0 | Nb 0.05, Ni 1.0 | 0 | 0 | 0 |

TABLE 4-continued

| | | Steel Composition | | | | | | | | Corrosion after Immersion in an Aqueous Solution of $Ca(OH)_2$ + 3.6% NaCl (ph 12) | | Corrosion in High-Salt Containing Concrete |
|---|---|---|---|---|---|---|---|---|---|---|---|---|
| | No. | C | Si | Mn | P | S | Al | Cr | Others | Rust Formation Area (%) (A) | Depth of Local Corrosion (mm) (B) | Rust Formation Area (%) (C) |
| Inven- | 36 | 0.81 | 0.015 | 0.01 | 0.007 | 0.003 | 18.0 | 1.1 | Nb 0.05, V 0.02 | 0 | 0 | 0 |
| tion | 37 | 0.82 | 0.005 | 0.15 | 0.011 | 0.005 | 12.0 | 1.2 | Mo 0.01, Nb 0.02, Cu 0.3 | 0 | 0 | 0 |
| Steels | 38 | 0.05 | 0.01 | 0.07 | 0.010 | 0.003 | 11.0 | 1.3 | Ti 0.2, V 0.1, Cu 0.2 | 0 | 0 | 0 |
| | 39 | 0.51 | 0.01 | 0.10 | 0.012 | 0.003 | 12.0 | 0.8 | V 0.05, Cu 0.2 | 0 | 0 | 0 |
| | 40 | 0.005 | 0.007 | 0.002 | 0.007 | 0.001 | 15.0 | 0.7 | V 0.2, Ni 3.5 | 0 | 0 | 0 |
| | 41 | 0.01 | 0.02 | 0.25 | 0.0150 | 0.002 | 11.2 | 0.9 | Ni 3.5, Cu 1.0 | 0 | 0 | 0 |
| | 42 | 0.05 | 0.10 | 0.10 | 0.007 | 0.001 | 10.0 | 1.2 | Ni 0.5, Cu 0.5 | 0 | 0 | 0 |
| | 43 | 0.80 | 0.20 | 0.03 | 0.012 | 0.002 | 10.0 | 0.7 | Cu 2.0, Ni 1.0 | 0 | 0 | 0 |
| | 44 | 0.08 | 0.18 | 0.10 | 0.010 | 0.001 | 12.0 | 0.8 | Cu 0.2, W 0.2 | 0 | 0 | 0 |
| | 45 | 0.82 | 0.05 | 0.10 | 0.008 | 0.002 | 8.0 | 1.0 | W 0.2, Cu 0.2 | 0 | 0 | 0 |
| | 46 | 0.05 | 0.02 | 0.18 | 0.002 | 0.001 | 9.0 | 1.2 | W 0.15, Ni 1.5 | 0 | 0 | 0 |
| | 47 | 0.90 | 0.10 | 0.05 | 0.008 | 0.002 | 10.0 | 2.0 | W 0.15, Ti 0.2 | 0 | 0 | 0 |
| | 48 | 0.86 | 0.05 | 0.02 | 0.001 | 0.001 | 10.0 | 1.5 | Mo 0.05, Ni 1.0 | 0 | 0 | 0 |
| | 49 | 0.85 | 0.005 | 0.005 | 0.001 | 0.001 | 15.0 | 1.8 | W 0.05, Ni 5.5 | 0 | 0 | 0 |
| | 50 | 0.05 | 0.01 | 0.01 | 0.002 | 0.002 | 19.0 | 2.1 | V 0.2, Ni 3.8 | 0 | 0 | 0 |

What is claimed is:

1. A concrete reinforcing steel bar or wire having a basic steel composition consisting essentially of:

C: not more than 1.0%
Si: not more than 0.25%
Mn: Not more than 2.0%
Al: 10.0 to 20.0%
Cr: 0.5 to 5.5%
P: not more than 0.015%
S: not more than 0.005%
Balance: essentially iron and unavoidable impurities.

2. A concrete reinforcing steel bar or wire according to claim 1, which further comprises at least one of Ti, V, Nb, W, Mo, and B in a total amount ranging from 0.01 to 0.5% for the elements other than B, and in an amount ranging from 0.0001 to 0.005% for B.

3. A concrete reinforcing steel bar or wire according to claim 1, which further comprises at least one of Cu and Ni in a total amount ranging from 0.1 to 5.5%.

4. A concrete reinforcing steel bar or wire according to claim 2, which further comprises at least one of Cu and Ni in a total amount ranging from 0.1 to 5.5%.

* * * * *